US006978582B2

(12) United States Patent
Bernard

(10) Patent No.: US 6,978,582 B2
(45) Date of Patent: Dec. 27, 2005

(54) GROUND SUPPORT BEAM FOR LONGITUDINAL BARRIER

(76) Inventor: Gwynn Alan Bernard, 555 Britt St., Leitchfield, KY (US) 42754

( * ) Notice: Subject to any disclaimer, the term of this patent is extended or adjusted under 35 U.S.C. 154(b) by 0 days.

(21) Appl. No.: 10/346,973

(22) Filed: Jan. 17, 2003

(65) Prior Publication Data

US 2004/0139686 A1 Jul. 22, 2004

(51) Int. Cl.[7] ..... E04C 3/30; E01C 11/22; E01F 9/06; E01F 15/04

(52) U.S. Cl. ..... 52/736.2; 52/737.2; 256/13.1; 256/59; 404/8; 404/10

(58) Field of Search ..... 52/736.1, 736.2, 52/737.2; 256/13.1, 59; 404/8, 10

(56) References Cited

U.S. PATENT DOCUMENTS

RE18,848 E * 5/1933 Shepard ..... 256/13.1
2,093,577 A * 9/1937 Shepherd ..... 256/13.1
2,907,552 A * 10/1959 Crone ..... 256/13.1
4,289,301 A * 9/1981 Akabame et al. ..... 256/13.1
5,044,609 A * 9/1991 Cicinnati et al. ..... 256/13.1
5,219,241 A * 6/1993 Picton ..... 404/6
5,657,966 A * 8/1997 Cicinnati ..... 256/13.1
5,876,020 A * 3/1999 Giavotto ..... 256/13.1
6,595,715 B1 * 7/2003 Cortell ..... 404/6

* cited by examiner

*Primary Examiner*—Carl D. Friedman
*Assistant Examiner*—Yvonne M. Horton
(74) *Attorney, Agent, or Firm*—Charles Lee Thompson

(57) ABSTRACT

A one piece beam means used a post to support a longitudinal impact-resistant member, such as a guardrail along a highway. The one piece, stamped construction simplifies installation because fewer steps and parts are involved.

2 Claims, 3 Drawing Sheets

GROUND SUPPORT BEAM FOR LONGITUDINAL BARRIER

The invention is a beam means for supporting an impact-resistant barrier member, such as a highway guardrail. The support beam is formed as a single piece.

BACKGROUND OF THE INVENTION

Several design considerations apply in respect to support means for highway guardrails. These considerations include safety and structural soundness, installability, and compliance with the applicable standards especially those of the Federal Highway Administration (FHWA). Within those criteria, a variety of designs are found in the prior art. Guardrails can be supported using a two-piece arrangement of a post with an offset block attached to the post. The guardrail-would be bolted to the offset block in this prior art arrangement. There are versions of offset blocks made of plastic, recycled rubber and composites, and wood. The present invention is an advance over the prior art, which had problems with a two-piece design and the installation problems of multiple parts, with how to anchor or drive the post into the roadside area, and with the unit cost and installation costs for a two-piece design.

Highway guardrails may be bolted to an offset block that is attached to a wooden post or a metal I-beam that is driven in the ground. That involves driving the post, delivering an offset block and hardware at each post along the highway, then joining those parts, then delivering the guardrails and hardware along the line of posts, then bolting the rails to the offset blocks. The present invention eliminates the separate offset block, and the associated joining and hardware, but it provides the lateral offset distance between the guardrail and the post that is desired.

A standard that is applied to guardrails to be used on the highways was set out in National Cooperative Highway Research Program (NCHRP) Report 350, Recommended Procedures for the Safety Performance Evaluation of Highway Features, for the Federal Highway Administration. It deals with crash test protocols used to test any design that may be offered, and it does not set a standard for the guardrail support beams and hardware.

It is desirable to have the location where the post is driven into the roadside to be set back from the guardrail, because experience has shown that the guardrail is more effective if the wheel of a vehicle does not strike the base of the support post.

DETAILED DESCRIPTION

Figure 1:
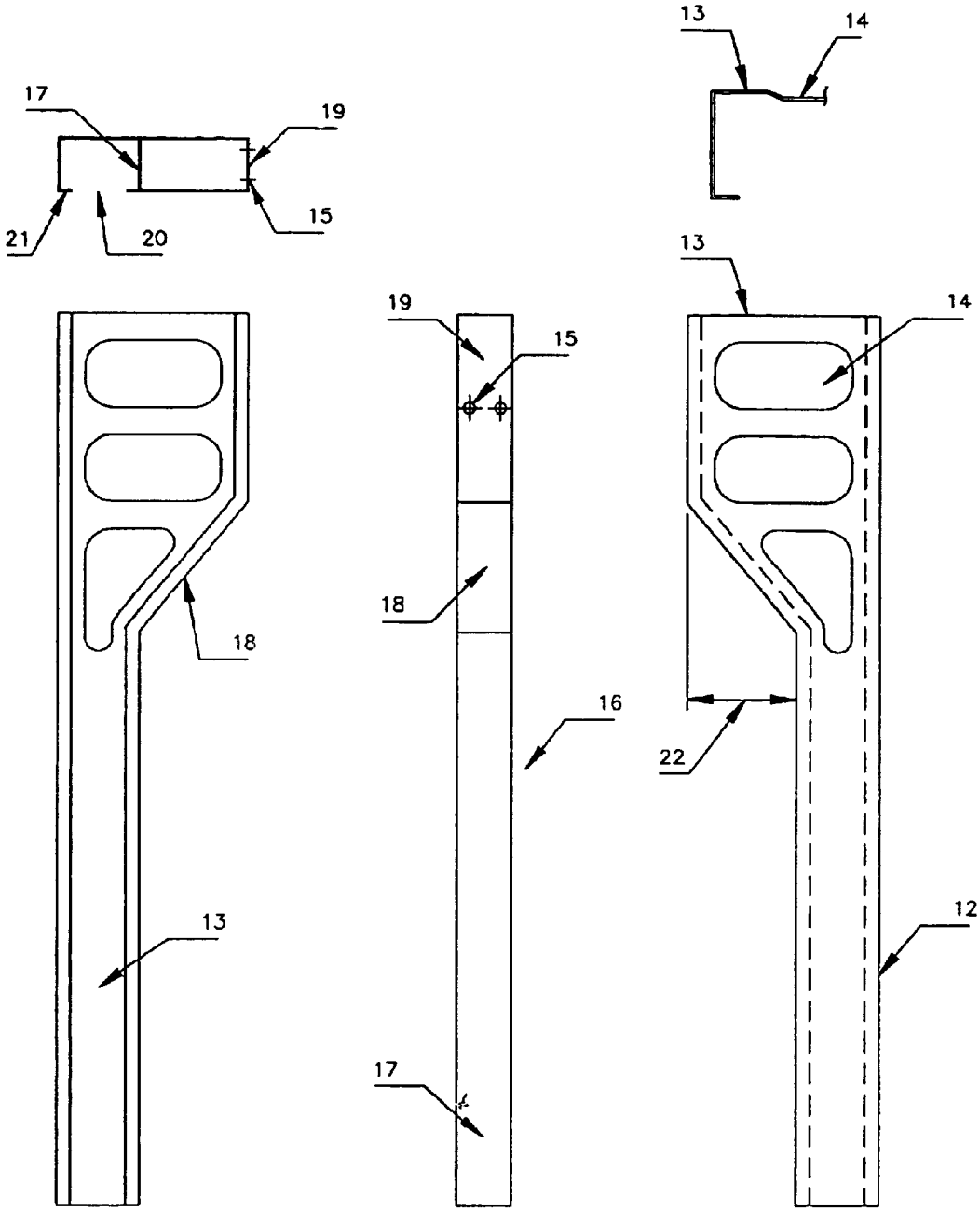
FIG. 1 has views of the three sides of beam means, and top views.
Figure 2:
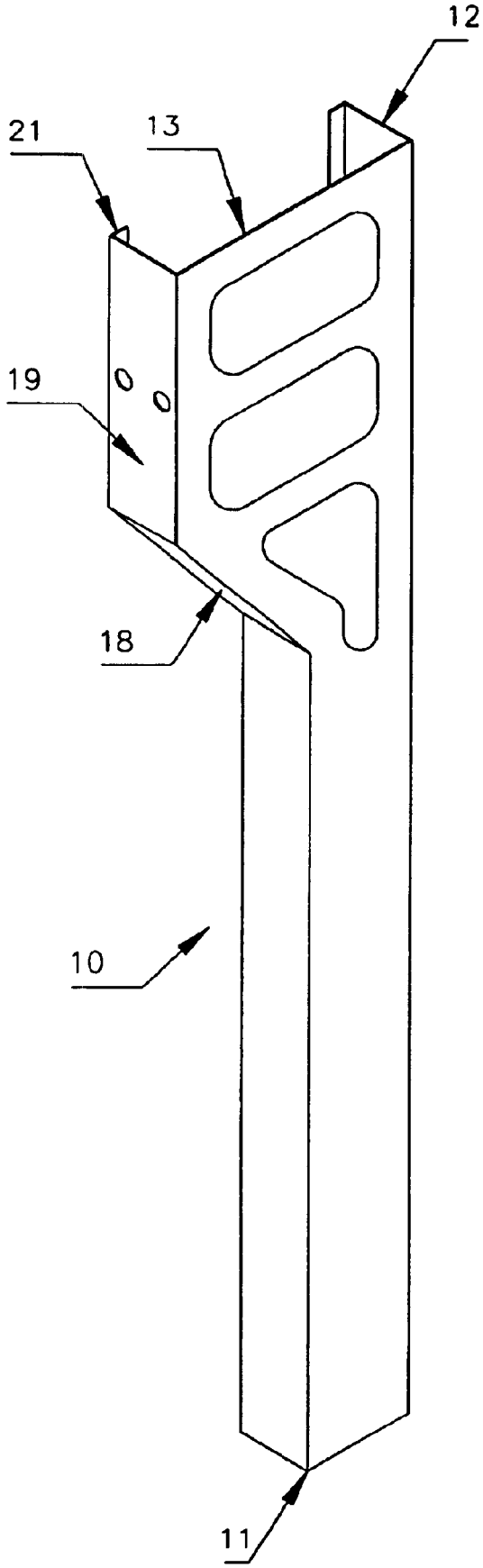
FIG. 2 is an isometric side view of the beam means.

The preferred embodiment of the beam means (10) of the present invention is formed from a single piece of galvanized steel that is stamped using a stamping die in a mechanical press. As depicted in FIGS. 1 and 2, the beam means has a bottom end (11) that will be driven into or anchored in the ground, and the other end or upper end is broader and it accepts elements for attaching and supporting the guardrail member, such as holes (15) for receiving bolts or other equivalent fasteners. In cross-section, the lower end of the beam resembles a C-shaped beam and has three closed sides, with the fourth side being mostly open (20). In the preferred embodiment, the mostly open side has edges (21), or cuffs, that provide structural integrity and make the beam more suited to being driven into the ground, especially when driven by a hammer. The upper end of the beam is broader than the lower end, and in the side view of the preferred embodiment, the side panel has approximately an 8-inch difference between the dimension of the lower end and the upper end. That offset distance (22) can be varied, and it will be conformed to provide the amount of lateral offset that crash tests or any applicable standards indicate is appropriate for the intended use and location alongside a highway. That lateral distance (22) between the point where the lower end is driven in the ground and the bolt receiving portion of the beam where the guardrail is attached is predetermined from testing the support beam, including crash testing.

Figure 3:
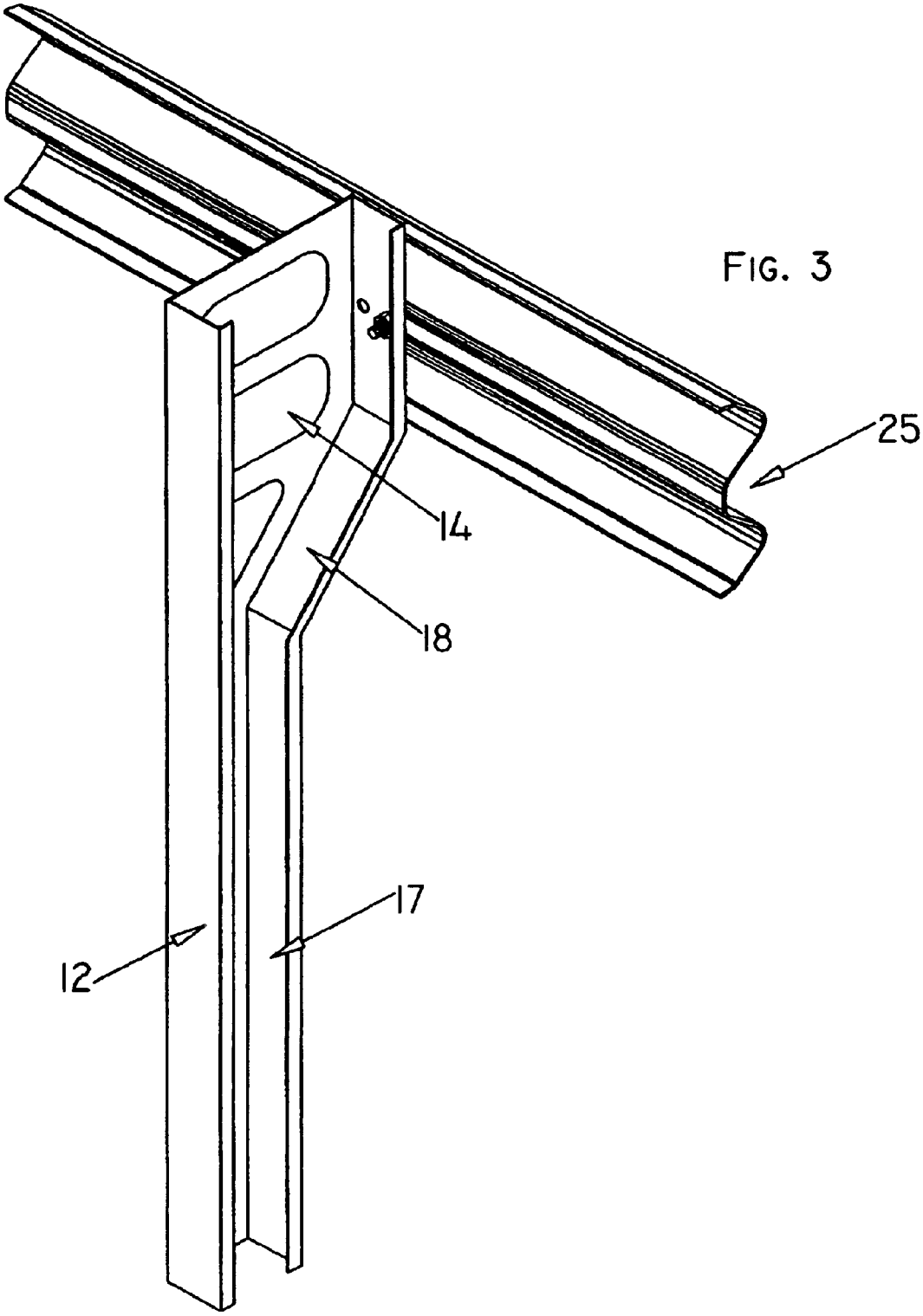
FIG. 3 depicts a typical arrangement of the beam means supporting an impact-resistant member, such as a guardrail.

The beam means has a front side, which has the openings as its upper end that receive the guardrail fasteners, a side panel, and a rear side. The rear is planar, and provides a rigid backbone (12) and the structural strength appropriate for being driven into the area alongside a highway, and appropriate for use in supporting an impact-resistant member like a highway guardrail (25). The backbone is preferably straight, so it can be hammer-driven straight into the ground. As FIG. 3 shows, from the top view the beam is formed as a rectangle with one open or mostly open (20) side.

Referring again to FIGS. 1 and 2, the open side of the beam is opposite a side panel (13) that preferably has reinforcing ribs (14) stamped into it, or alternatively has equivalent reinforcing elements. In the preferred embodiment, these reinforcing elements are stamped in the upper part of the side panel and even in the intermediate portion, but not in the lower portion. The number and location of the reinforcing elements is based on manufacturing considerations and the desired amount of structural reinforcement that is desired.

The backbone (12), the reinforced side panel (13) and the front side preferably are one-piece of stamped metal integrally that is formed. The backbone panel (12) has the same dimensions from the bottom end to the upper end of the beam. The side panel (13) is wider at the upper end than at the bottom end. The transition from the broader upper end down to the lower end can be formed by an angular intermediate portion, or by an equivalent non-angular or tapered section between the upper and lower ends. Similarly, the front side (16) of the support member has a lower end (17) that is set back an appropriate distance (22) from the upper end (15), and that can be bridged with angular or tapered intermediate portion (18) that transitions between the upper and lower ends.

In a preferred embodiment, the front side (16) of the beam (10) is formed having three portions, which are a lower front portion (17) on the bottom end of the beam, an intermediate portion (18), and a bolt-receiving portion (19) at the upper end. Also, the front panel, the lower portion (17) and the receiving portion (19) are on substantially parallel planes, while the intermediate portion (18) is not and preferably it is at an inclined plane in relation thereto. The intermediate portion (18) preferably is angled with respect to the lower portion and the receiving portion (19), such that the front of the beam is non-linear from top to bottom. The non-linearity of the front of the support beam is defined by the three planes that define the three portions of that front panel, which are the parallel lines of the lower front portion and the bolt-receiving portion of that panel, and the non-linear or non-parallel plane of the intermediate portion of the front panel.

An angular or tapered transition is formed between these three portions can provide the equivalent means, and serve test-safety or based on manufacturing considerations. As long as the part is a one-piece support beam, or its equivalent, with a rail-supporting upper end that is broader than the lower end that is driven in the ground, then that one-piece beam means as depicted in the FIGS. 1, 2, 3 and 4, then that part would embody the essential features of the present invention, and be an equivalent of the present invention.

As FIGS. 1 and 2 indicate, the distance (22) from the backbone to the bolt-receiving portion of the front panels greater than the distance from the backbone to the lower front portion. The intermediate portion provides an offset distance (22) between the bolt-receiving portion (19) and the lower front portion (18) which distance serves a safety purpose of preventing the wheel of a vehicle that strikes the guardrail from also coming in contact with the lower portion of the supporting beam where it is anchored in the ground.

It should be understood that this detailed description and specific examples, while indicating preferred embodiments of the invention, are given for illustrative purposes, since various changes and modifications may be contemplated by those skilled in the art which are within the spirit and scope of the beam means of the present invention.

I claim as my invention:

1. A support post comprising:

beam means for supporting a longitudinal impact-resistant member, said beam means being one piece comprising a backbone panel, a side panel and a non-linear front panel with means for connecting to said member;

said backbone comprising a rear panel with a side flange, said rear panel joined to said side panel, said side panel formed of an upper portion with reinforcing rib means and a lower panel, said upper portion having a width greater than that of said lower portion and said side panel joined to said front panel, said front panel formed of a lower front portion, a bolt-receiving upper portion and an intermediate portion at an inclined plane in relation to said upper and lower portion.

2. A post for driving into the ground and supporting a guardrail, comprising:

a longitudinal member of unitary construction, having panels on three sides, a rectangular rear panel, a planar non-rectangular side panel, and a non-linear front panel, said rear panel having an upper end, a lower end and longitudinal edges that define a rectangle, said lower end for being driven into the ground, and said first longitudinal edge having a cuff, and said second longitudinal edge being joined to said side panel, said side panel having an upper end and a lower end, said lower end for being driven into the ground, and said lower end and said upper end joined by a non-rectangular intermediate portion having a lower dimension that is the width of said lower end and an upper dimension that is the width of said upper end of said side panel, wherein said side panel has reinforcing ribs stamped in said upper portion of said side panel, and said front panel formed of a lower front portion, which is joined to said lower end of said side panel, a bolt-receiving upper portion, which is joined to said upper end of said side panel, and an intermediate portion of said front panel, which is joined to said intermediate portion of said side panel.

* * * * *